US007143539B2

(12) United States Patent
Cerovic et al.

(10) Patent No.: US 7,143,539 B2
(45) Date of Patent: Dec. 5, 2006

(54) ELECTRIC DISCHARGE WEAPON

(75) Inventors: Milan Cerovic, Scottsdale, AZ (US); David Dubay, Phoenix, AZ (US)

(73) Assignee: Taser International, Inc., Scottsdale, AZ (US)

( * ) Notice: Subject to any disclaimer, the term of this patent is extended or adjusted under 35 U.S.C. 154(b) by 0 days.

(21) Appl. No.: 10/893,467

(22) Filed: Jul. 15, 2004

(65) Prior Publication Data

US 2006/0026884 A1 Feb. 9, 2006

(51) Int. Cl.
*F41B 15/04* (2006.01)

(52) U.S. Cl. ..... 42/84; 42/1.08; 102/502; 361/232

(58) Field of Classification Search ..... 42/1.08, 42/105, 84, 71.01, 72; 89/1.1, 1.11, 135; 102/502, 472; 361/232
See application file for complete search history.

(56) References Cited

U.S. PATENT DOCUMENTS

| | | | | |
|---|---|---|---|---|
| 4,285,153 | A | 8/1981 | Crouch | 42/84 |
| 5,272,828 | A * | 12/1993 | Petrick et al. | 42/84 |
| 5,930,935 | A | 8/1999 | Griffin | |
| 6,571,503 | B1 * | 6/2003 | Thorpe | 42/114 |
| 2003/0106415 | A1 * | 6/2003 | Smith | 89/1.11 |
| 2004/0017178 | A1 * | 1/2004 | Chang | 320/114 |
| 2004/0045207 | A1 * | 3/2004 | McNulty | 42/40 |

* cited by examiner

*Primary Examiner*—Michael J. Carone
*Assistant Examiner*—Stewart T. Knox
(74) *Attorney, Agent, or Firm*—William R. Bachand

(57) ABSTRACT

A weapon, according to various aspects of the present invention, includes a receiver, a trigger, and a cartridge store. The receiver receives a cartridge. The cartridge applies a deterrent force to the target. The trigger activates the cartridge. The cartridge store stores a plurality of provided cartridges. The cartridge store, then the trigger, and then the receiver are arranged in sequence proceeding linearly away from a user of the weapon.

14 Claims, 8 Drawing Sheets

ELECTRIC DISCHARGE WEAPON

FIELD OF THE INVENTION

Embodiments of the present invention relate to weapons that apply force to incapacitate a target, for example, non-lethal force.

BACKGROUND OF THE INVENTION

Today's military and police encounter situations where application of both lethal and non-lethal force is desirable. For example, in many of today's "hot-spots" around the world, military units perform crowd control duties involving a crowd that is initially relatively peaceful but then degenerates into a violent and dangerous mob. In such situations, a soldier may need a way to subdue violent elements in the crowd using non-lethal force while retaining a means for applying lethal force in order to further protect himself if the crowd becomes violent and dangerous. In these situations, soldiers typically hold one weapon at a time, the weapon of choice being some sort of lethal force weapon such as a rifle. When confronted with a situation where non-lethal force may be more appropriate, the soldier may not have a non-lethal weapon ready.

Consequently, there is a need to provide non-lethal force weapons simultaneously with lethal force weapons and integrate operation for ready access by a policeman or soldier.

SUMMARY OF THE INVENTION

A weapon, according to various aspects of the present invention, includes a receiver, a trigger, and a cartridge store. The receiver receives a cartridge. The cartridge applies a deterrent force to the target. The trigger activates the cartridge. The cartridge store stores a plurality of provided cartridges. The cartridge store, then the trigger, and then the receiver are arranged in sequence proceeding linearly away from a user of the weapon.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

A multi-function weapon delivers force for offensive or defensive purposes. Force is delivered in multiple ways at the discretion of the operator. Force in each way may be lethal or non-lethal. In a first example, a conventional multi-function weapon may include a rifle with an attached chemical discharge device. Operation of the rifle (e.g., loading and firing) is largely independent of operation of the chemical discharge device that has its own mechanisms for loading and firing, though aiming of each may be in common. In a second example, a multi-function weapon may have multiple independent firing mechanisms. For example, a rifle may have an electric discharge weapon attached to it for common aiming. The rifle and electric discharge weapon may each have an independent means for loading and firing.

According to various aspects of the present invention, a conventional weapon or a conventional multi-function weapon may be used as a multi-function weapon system by attaching an electric discharge weapon to the conventional weapon or conventional multi-function weapon.

An electric discharge weapon delivers an electric charge to a target. Delivery may be via a probe propelled toward the target by the weapon. The probe may include conductive filaments that extend from the weapon to the probe at the target, for example, to supply the electric charge. In another implementation, the probe may include a power supply (e.g., comprising a battery) and the conductive filaments may be omitted. Generally, a portion of the electric discharge weapon is reusable for subsequent targets. The portions consumed for one target may be packaged as a round of ammunition; or may be packaged in a replaceable cartridge removably affixed to the reusable portion of the weapon. It is desirable to carry with the electric discharge weapon a supply of the consumable portions (e.g., rounds or cartridges).

Figure 1:
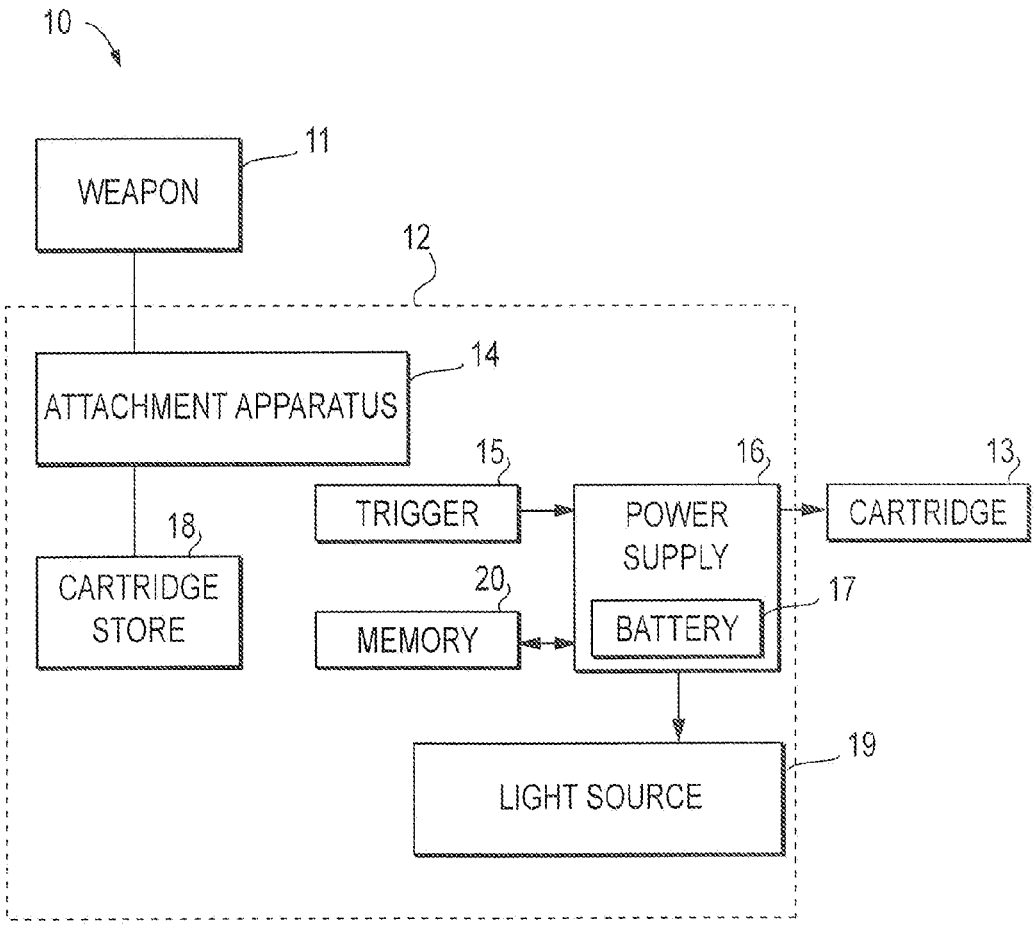
FIG. 1 is a functional block diagram of a multi-function weapon system according to various aspects of the present invention.

For example, multi-function weapon system 10 of FIG. 1 includes conventional weapon 11, electric discharge weapon 12, and cartridge 13. Electric discharge weapon 12 includes attachment apparatus 14, trigger 15, power supply 16 (that may include battery 17), cartridge store 18, light source 19, and memory 20. Each weapon 11 and 12 is typically operated by the same human operator from time to time against targets (e.g., humans, domestic animals, game, wild animals).

Any conventional weapon may be used. For example, weapon 11 in various implementations of system 10 may include a weapon providing offensive or defensive force of any magnitude against humans and/or animals (e.g., a firearm, a chemical discharge source, a nozzle for a high pressure stream of water, launchers for projectiles, nets or restraints, and acoustic devices).

An attachment apparatus joins conventional weapon 11 and electric discharge weapon 12 for operation as a mechanical unit. Joining may be rigid, flexible, or adjustable among a set of rigid positions. For example, attachment apparatus 14 may include any conventional materials, structures, and techniques adapted to the shape and structural features of weapons 11 and 12. Weapon 11 may include conventional mounting structures for attaching accessories to weapon 11. Attachment structure 14 in various implementations includes structures that mate, nest, abut, engage, adhere, fasten, and/or cooperate for attachment with such mounting structures as discussed above. Weapon 11 and/or weapon 12 may include fasteners to which attachment apparatus cooperates. For example, weapon 11 and/or 12 may include a threaded orifice; and, attachment apparatus may include a threaded fastener compatible with the threaded orifice for joining as discussed above.

A trigger, power supply, memory, and light source cooperate to control and facilitate operation of cartridge 13. For example, in one implementation, trigger 15, power supply 16, battery 17, light source 19, and memory 20 use structures and methods of operation of the type described in U.S. Pat. No. 4,253,132 by Cover issued Feb. 14, 1981, U.S. Pat. No. 6,636,412 by Smith issued Oct. 21, 2003, and U.S. patent application Ser. No. 10/447,447 by Nerheim filed May 29, 2003, all incorporated herein by reference.

Trigger 15 may include a primary mechanism for activating power supply 16 so as to activate (e.g., fire) cartridge 13; and, a secondary mechanism. The secondary mechanism may operate as a conventional safety to block unintended operation of the primary mechanism. Further, the secondary mechanism may control whether or not light source 19 is activated. In one implementation, the secondary mechanism has three positions: safety off with light source disabled, safety off with light source enabled, and safety on. Primary and secondary mechanisms may comprise mechanical apparatus and/or electrical switches.

A cartridge store keeps unused cartridges convenient for use. Keeping may include enclosing (e.g., cartridges that have no suitable means for mechanical retention) and/or mechanically restraining (e.g., holding in a fixed position relative to other cartridges, weapon 12 and/or weapon 11). For example, store 18 may be integral to the structure of weapon 12, may hold only unused cartridges (e.g., to avoid mistaking ready cartridges from spent cartridges) of a type suitable for use with weapon 12 for a particular mission, and protects each stored cartridge from damage or activation. These features are implemented in suitable structures of store 18 that are compatible with conventional cartridges and involve conventional materials and mechanical techniques. In another implementation, according to various aspects of the present invention, store 18 includes a shape to serve as a suitable hand grip for proper use of weapon 11 and/or weapon 12. By locating a hand on store 18 and a hand on trigger 15, unintended use of a trigger of weapon 11 may be avoided.

Figure 2A:
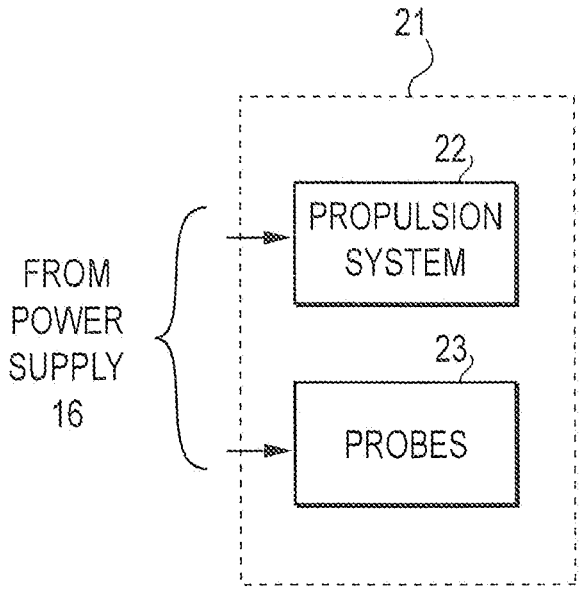
FIG. 2A is a functional block diagram of a cartridge 13 in one implementation for use with the weapon system of FIG. 1.
Figure 2B:
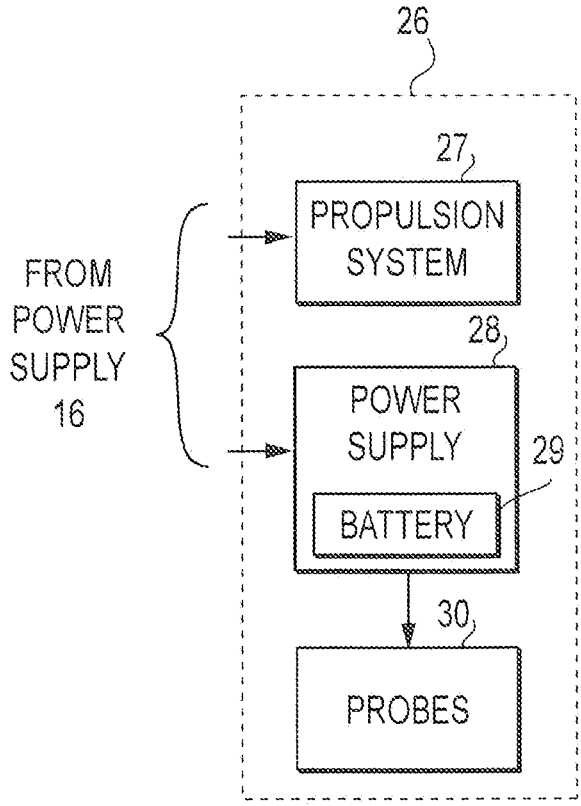
FIG. 2B is a functional block diagram of a cartridge 13 in another implementation for use with the weapon system of FIG. 1.

A cartridge provides consumable supplies for operation of an electric discharge weapon. For example, cartridge 13 may include functions of cartridge 21 of FIG. 2A or cartridge 26 of FIG. 2B. Cartridge 21 includes conventional probes and propulsion system to propel the probes. Cartridge 21 receives electrical power from power supply 16 for activating propulsion system 22 and enabling probes 23 to deliver an electric charge in a circuit that includes the target. Cartridge 26 further includes a miniature power supply 28 that may include an energy storage device (e.g. battery 29 or a capacitor). Cartridge 26 may be of the type described in U.S. Pat. No. 5,654,867 by Murray issued Aug. 5, 1997 incorporated herein by reference. Propulsion systems 22 and 27 may include electrically primed explosive or pressurized gas. In one implementation, propulsion systems 22 and 27 are of the type described in U.S. Pat. No. 5,078,117 by Cover issued Jan. 7, 1992 incorporated herein by reference.

Cartridge 13 may be operatively coupled to weapon 12 in any conventional manner. For example, in one implementation, cartridge 21 is fastened to weapon 12 using a quick connect fastener and receives electrical energy via a butt contact interface. In another implementation, a cartridge similar to cartridge 26 is used wherein coupling from power supply 16 to cartridge 26 is omitted. Such a cartridge is loaded into a chamber of weapon 12 in a manner similar to a round of conventional ammunition and activated by a conventional percussion pin.

An electric discharge weapon of the type described above may be implemented with a substantially linear arrangement of components. For example, a weapon may include a linear arrangement in an order proceeding toward the operator that includes a cartridge loaded for use, an activator to activate the loaded cartridge, and a cartridge store. In another implementation, the weapon may include a linear arrangement in an order proceeding toward the operator that includes a cartridge loaded for use, a cartridge store, and an activator to activate the loaded cartridge. The operation of replacing a spent cartridge with a cartridge from the cartridge store may be manual, manually initiated, or fully automatic (e.g., initiated a time after firing while a trigger is held in an active position).

An electric discharge weapon may apply non-lethal force such as that applied by a weapon of the type marketed by Taser International, Inc. Electric discharge weapons deliver an electrical charge to a human or animal target to stun and/or immobilize the target with little risk of serious injury. An exemplary electric discharge weapon according to various aspects of the present invention may include a mount, an activator, and a cartridge store.

The mount may be adapted for coupling to a firearm. The mount may have a bayonet mount slot for receiving a bayonet mount of the firearm. The mount may also include an attachment fastener that extends into the bayonet mount slot for holding the bayonet mount of the firearm in the bayonet mount slot. The bayonet mount slot may further include a groove for receiving a protrusion of the bayonet mount. The mount may also have a rail slot adapted for slidably receiving a rail of the firearm. The rail slot may include a longitudinal groove adapted for receiving a flange of the rail of the firearm inserted into the rail slot. In use, the rail of a firearm may be inserted into the rail slot of the mount of the electric discharge weapon while the bayonet mount of the firearm may be inserted into a bayonet mount slot of the mount.

The activator may include a receiver that accepts a cartridge to be activated. A cartridge installed in the receiver is said to be loaded. The activator may have a finger hole and an actuator extending into the finger hole. The activator may also have a light source. In one embodiment, the light source may comprise a coherent light source.

The cartridge store may have one or more compartments for receiving a cartridge. Each compartment of the cartridge store may have a notch for receiving a portion of a latch of a cartridge. The compartment of the cartridge store may also have a resiliently compressible wall.

After mounting the electric discharge weapon onto a firearm and loading a cartridge into the receiver of the electric discharge weapon, the firearm may be held to aim the electric discharge weapon at a target. The electric discharge weapon may be activated to propel a projectile from the activator of the electric discharge weapon towards the target so that an electric charge may be delivered in a circuit that includes the target.

According to various aspects of the present invention, an electric discharge weapon 100 of FIGS. 3 through 11, includes activator 102, mount 104 and cartridge store 106. Activator 102 is located toward the front or distal end of electric discharge weapon 100. Cartridge store 106 is located toward the rear or proximal end of electric discharge weapon 100. And, mount 104 is located above both activator 102 and cartridge store 106.

Activator 102 includes a body or main housing 108 having a forward-located socket herein called a receiver 110 for receiving a cartridge 112. Cartridge 112*a* may have one or more resiliently depressible latches 114*a* for engaging receiver 110 to releasably hold cartridge 112*a* in receiver 110. In such embodiment, a latch 114*a* may be provided on each lateral side of cartridge 112*a* to enhance quick and easy releasing of latches 114*a* with a user's forefinger and thumb.

Activator 102 may also include a rearward located trigger region 116 that has a finger hole 118 for receiving a user's finger therein and a primary actuator (e.g., a trigger) 120 extending into at least a portion of finger hole 118 so that primary actuator 120 may be actuated by the user's finger that extends into finger hole 118. Primary actuator 120 may be utilized to actuate various elements of activator 102. Trigger region 116 may also include a handgrip area 122 for gripping by a user's hand with the user's finger is extended into finger hole 118. Trigger region 116 may also include a secondary actuator 124. Primary and secondary actuators 120 and 124 implement functions of trigger 15 discussed above. Secondary actuator 124 may include a slide switch, slid between locked and unlocked positions. Secondary actuator 124 may be coupled to primary actuator 120 so that when secondary actuator 124 is in the locked position, primary actuator 120 cannot be actuated and, conversely, when secondary actuator 124 is in the unlocked position, primary actuator 120 can be actuated.

Activator 102 may further include an illumination compartment 126 that houses one or more light sources. Illumination compartment 126 may be located beneath body 108 of activator 102 and include a transparent or translucent window 128 for light emission toward the target.

A light source included in illumination compartment 126 may comprise a coherent light source such as, for example, a laser, for forwardly projecting a beam of coherent light toward a target. The coherent light source may be in alignment with cartridge 112*a* so that light from the coherent light source can be used to pinpoint (i.e., illuminate) an intended target. The light source may be aligned in a path generally parallel to the expected flight path of at least one of the probes (such as e.g., a top probe) so that the beam of light emitted from the light source may be used to approximate an intended target for the associated probe.

In addition to, or instead of, the coherent light source, illumination compartment 126 may include another light source, for example, one or more light emitting diodes (LEDs), for providing illuminating to a more generalized area in front of electric discharge weapon 100. The LEDs may preferably comprise a type of LED known as a super bright illumination LED.

Cartridge store 106 may have a plurality of compartments 132*a*, 132*b* that may be formed by a plurality of cutouts in cartridge store 106. Each compartment 132*a*, 132*b* is adapted for receiving a cartridge (e.g., cartridges 112*b*, 112*c*). Compartments 132*a*, 132*b* may have open bottoms to permit removal of a stored cartridge by a user grasping a cartridge and pulling on the cartridge in a downwards motion away from cartridge store 105. Conversely, the open bottoms permit a user to insert a cartridge into a compartment by positioning the cartridge below the compartment and then inserting the cartridge into the compartment using an upwards motion.

One or more latches (e.g., latches 114*b*, 114*c*) of a cartridge inserted into a compartment 132*a*, 132*b* may engage cartridge store 106 to releasably hold the cartridge in the compartment. Cutouts into the cartridge store may be shaped so that the opening into each compartment has an exposed area 134*a*, 134*b* that exposes the latch to permit a user to access the latch (e.g., depress the latch with the user's fingers) to disengage the latch from cartridge store 106 and thereby permit removal of the cartridge from the compartment.

The contour of the cutout may be shaped to form a generally semicircular exposed area 134*a*, 134*b*. Where a cartridge has a pair of latches located on lateral sides of the cartridge, the compartment may have a corresponding pair of exposed areas on opposite sides of the cartridge store to expose both latches of a cartridge inserted into the compartment.

Cartridge store 106 may further include a plurality of generally ring-shaped ridges 136, 138, 140 for providing gripping surfaces for a user's hand when grasping the cartridge store. A ridge may be provided at both ends of cartridge store 106 (e.g., ridges 136, 140) and between each adjacent pair of compartments 132*a*, 132*b* (e.g., ridge 138).

Mount 104 is adapted for mounting to the underside of a weapon and may comprise forward and rearward regions 142, 144. Forward region 142 may have an upper face that lies in a plane located above a plane in which an upper face of rearward region 144 lies. The upper faces of forward and rearward regions 142, 144 may also be substantially parallel with each other.

Forward region 142 may also have an attachment fastener 146 that extends into a rear area of forward region 142. Attachment fastener 146 may comprise a threaded fastener (e.g., a screw or threaded bolt) that is threadably extended through a corresponding threaded bore 148 in forward region 142 (see FIG. 5). Attachment fastener 146 may also include a finger-engaging turning portion 150 that has a diameter larger than the rest of threaded fastener to aid easier rotation of the attachment fastener by a user's fingers. An outer circumference of finger-engaging turning portion 150 may be frictionally enhanced (e.g., by including ridges or grooves in the circumference) to enhance a user's grip when turning attachment fastener 146.

Figure 3:
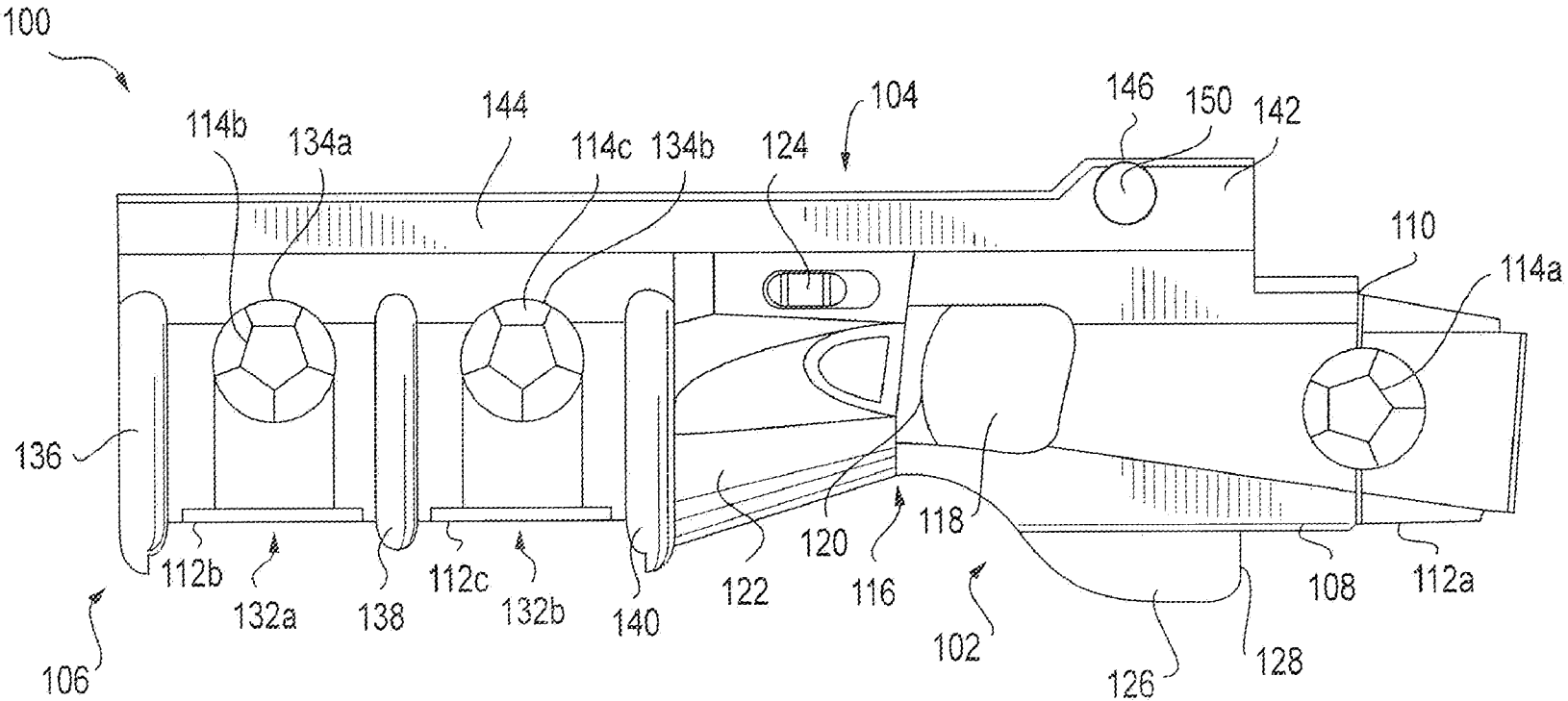
FIG. 3 is a side view of an electric discharge weapon according to an implementation of FIG. 1.

Projectiles may comprise a pair of probes. Each probe may have a pointed tip for penetration of clothing or skin of a target. Tips may be barbed to help hold the tip after penetration. Each probe may be electrically conductive and may be coupled to the activator by a flexible conductive filament. Probes may be positioned in a vertical alignment in cartridge 112*a* so that one probe is located above the other probe (i.e. so that there is a top probe and a bottom probe) when electric discharge weapon 100 is positioned in a typical upright position (as shown in FIG. 3). Prior to discharge, probes and filaments may be contained in a compartment or cavity inside cartridge 112*a* that is covered by a removable cover. The cover may comprise a pair of blast doors that are blown away from the compartment by the discharge of probes out of cartridge 112*a*. The cavity may also contain a plurality of tracking tags having indicia of identification (e.g. a unique serial number) to identify the associated cartridge 112*a*. In use, as a result of probes being discharged from cartridge 112*a*, tracking tags are also expelled from cartridge 112*a* to permit subsequent identification of discharged cartridge 112*a* and general location where cartridge 112*a* was discharged based on the tracking tags and the location where the expelled tracking tags 182 land.

An electric discharge weapon 100 may be mounted to a conventional weapon 400 as in FIGS. 4–12. Firearm 400 may comprise a rifle, for example, an M16-type rifle (e.g., a model M16A1). Firearm 400 may include stock 402; firing assembly 404 with hand grip 406, trigger 408, and ammunition cartridge 410; and barrel 412 with hand guard 414, sight 416, and bayonet mount 418 located beneath sight 416. Hand guard 414 of barrel 412 may include an underside rail 418 (also known as a picatinny rail) to which various attachments may be mounted (e.g., such as a 40 mm model M203 grenade launcher).

Figure 4:
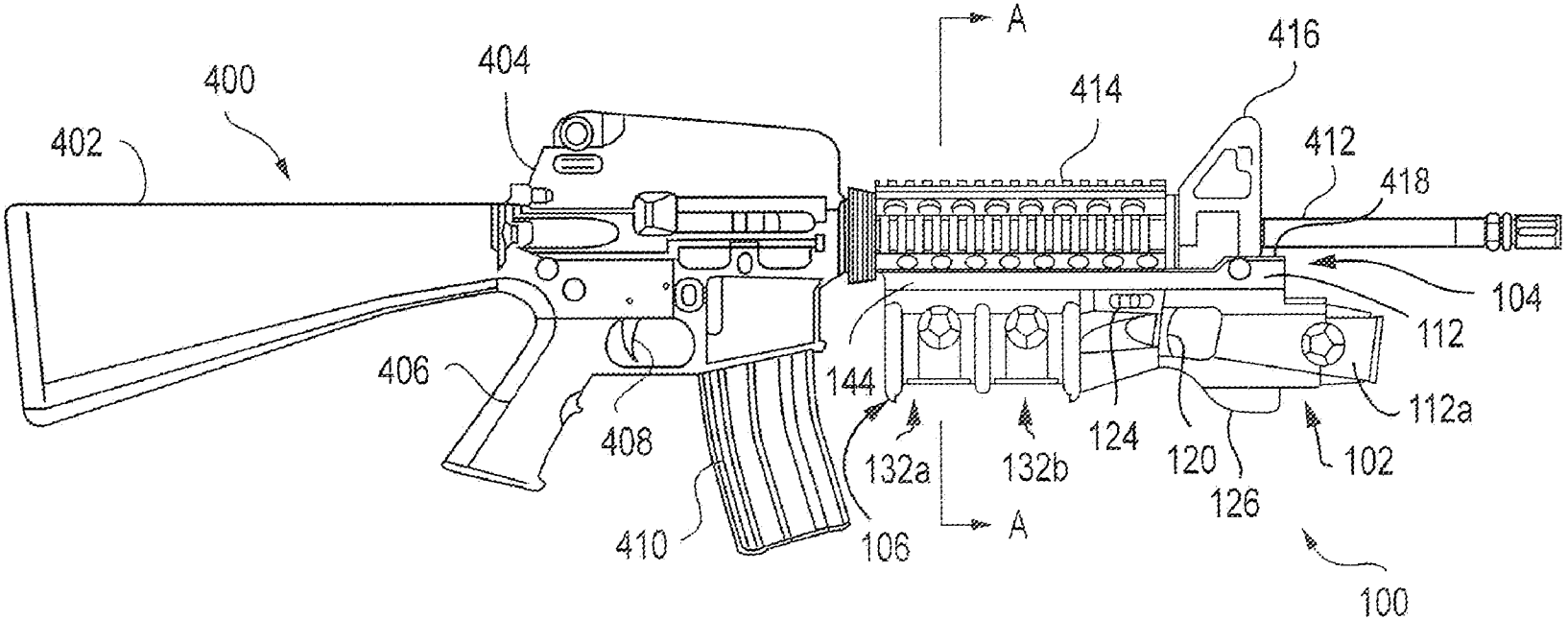
FIG. 4 is a side view of a multi-function weapon system according to an implementation of FIG. 1.

Mount 104 of electric discharge weapon 100 may be mounted to hand guard 414 and bayonet mount 418 of firearm 400 to couple electric discharge weapon 100 to the underside of barrel 412 of firearm 400. As shown in FIG. 4, when coupled to firearm 400, electric discharge weapon 100 may be in a generally parallel alignment with barrel 412, with activator 102 positioned towards the muzzle of barrel 412, and with finger hole 118 located beneath sight 416.

In general, rearward region 144 of mount 104 may include a rail slot 184 for receiving rail 420 of hand guard 414; and, forward region 142 of mount 104 may include a bayonet mount slot 186 for receiving bayonet mount 418 of firearm 400. Attachment faster 146 may be positioned to hold bayonet mount 418 in bayonet mount slot 186 between the front end of mount 104 and attachment fastener 146.

Figure 5:
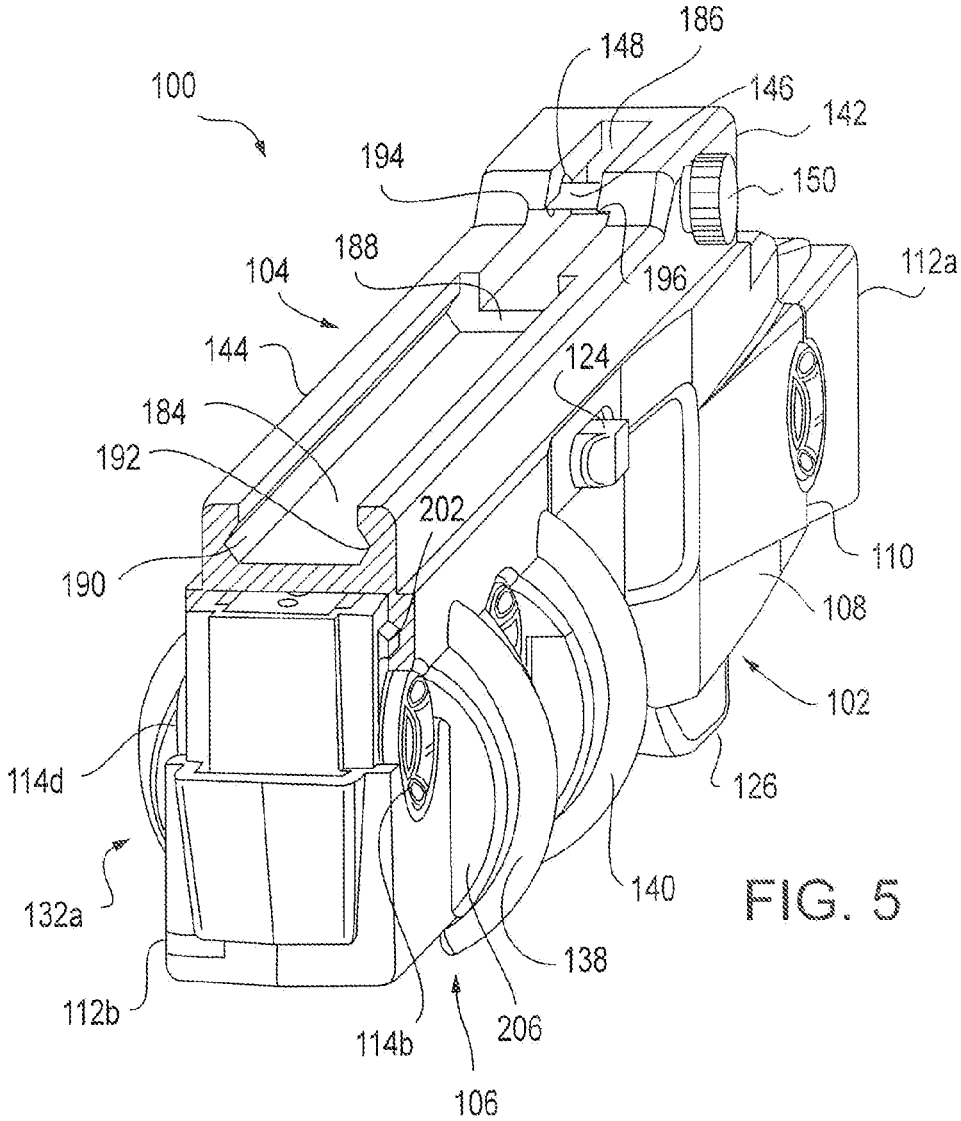
FIG. 5 is a perspective view of a forward portion of the weapon of FIG. 3, a portion of the rear of the weapon cut away to show in cross section a cartridge retained in the cartridge store.
Figure 6:
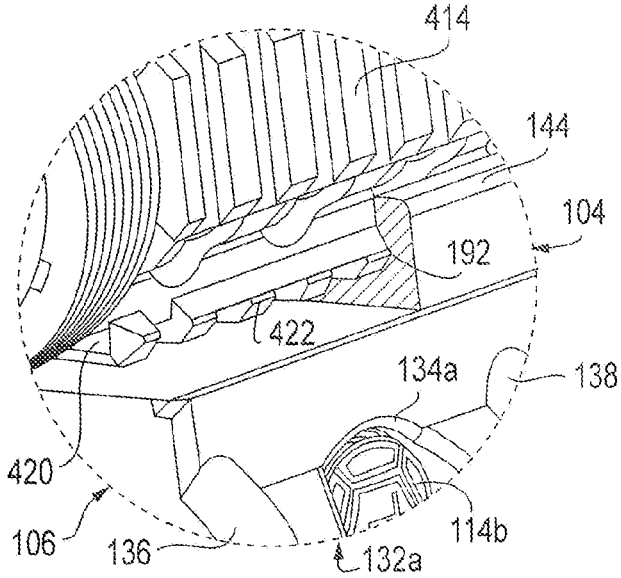
FIG. 6 is a perspective view of a portion of the weapon system of FIG. 4, a portion of the track cut away to show in cross section the assembly of the weapon system of FIG. 4.
Figure 7:
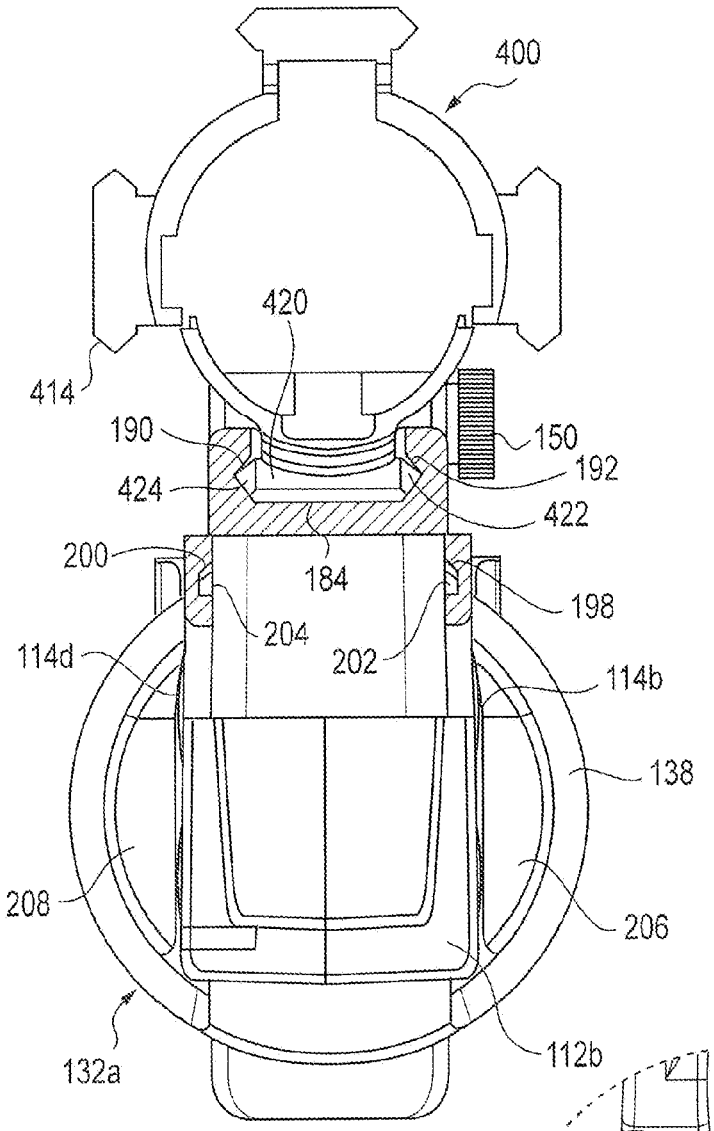
FIG. 7 is a cross section view A—A of the weapon system of FIG. 4 where the sight 416 is omitted and the cartridge 132*a* is not cross sectioned.
Figure 8:
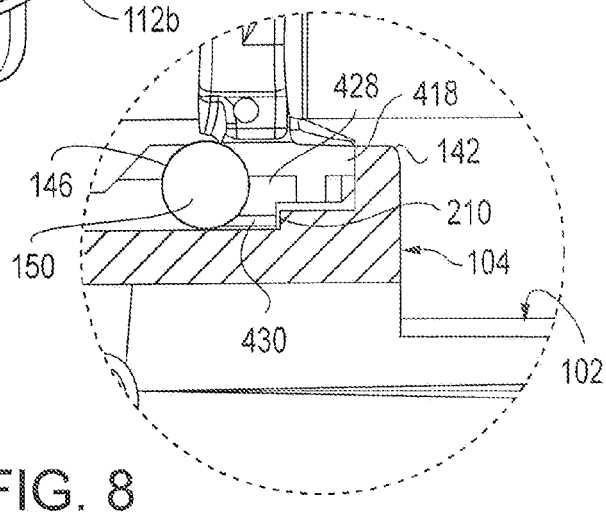
FIG. 8 is a cross section view of a central portion of the weapon system of FIG. 4 generally below sight 416.

With particular reference to FIGS. 5–7, rail slot 184 provides an opening into the upper face of rearward region 144 of mount 104 for receiving rail 420. Rail slot 184 may extend in a longitudinal direction along rearward region 144. Rail slot may have an open rear end at the rearward end of mount 104. Rail slot 184 has a front end that terminates at a stop 188 at the rear end of bayonet mount slot 186 (which is positioned above the bottom face of rail slot 184). Rail slot 184 may include a generally parallel pair of opposing lateral grooves 190, 192 extending between the rear and front ends of rail slot 184 that are adapted for receiving corresponding side flanges 422, 424 of rail 420 of weapon 400 (see FIGS. 5–7). Lateral grooves 190, 192 help hold rail 420 in rail slot 184. As shown in FIGS. 5–7, lateral grooves 190, 192 may have a generally V-shaped cross section that corresponds to the shape of side flanges 422, 424.

With particular reference to FIGS. 5 and 9–12, bayonet mount slot 186 has an open rear end that starts at stop 188 formed at the front end of rail slot 184. As illustrated in FIG. 5, the rear end and adjacent rear portion of bayonet mount slot 186 may be located on the upper face of rearward region 144 of the mount while the forward portion of bayonet mount slot 186 extends into forward region 142 of mount 104 and provides an opening into the upper face of forward region 142. Forward region 142 may form a pair of lateral shoulders 194, 196 in the forward portion of bayonet mount slot 186 which define corresponding lower grooves in the bayonet mount slot. When inserted into bore 148 through forward region 142, attachment fastener 146 may extend across bayonet mount slot 186.

Electric discharge weapon 100 may be mounted to weapon 400 by positioning mount 104 below barrel 412 of weapon 400 so that the front end of rail 420 is positioned just behind the open rear end of rail slot 184 and side flanges 422, 424 of rail 420 are aligned with lateral grooves 190, 192 of rail slot 184. Electric discharge weapon 100 may then be moved in a rearward direction toward firing assembly 404 of weapon 400 to insert rail 420 into the open rear end of rail slot 184 and to insert side flanges 422, 424 into lateral grooves 190, 192. Electric discharge weapon 100 may be moved further in the rearward direction to slide rail 420 of weapon 400 forward through rail slot 184 until the front end of rail 420 abuts stop 188 at the front end of rail slot 184 (See FIG. 8). When rail 420 is fully inserted into rail slot 184, lateral grooves 190, 192 help to reduce up and down movement of rail 420 in rail slot 184 and thereby help hold rail 420 securely in place inside rail slot 184.

As rail 420 slides forward toward stop 188, bayonet mount 418 of weapon 400 may enter the open rear end of bayonet mount slot 186. It should be noted that by this point, attachment fastener 146 should be removed from mount 104 to permit further insertion of bayonet mount 418 into bayonet mount slot 186. As electric discharge weapon 100 is moved further rearward, bayonet mount 418 may slide further forward into bayonet mount slot 186 so that side protrusions 426, 428 on bayonet mount 418 may be inserted into the lower grooves (formed by lateral shoulders 194, 196) of bayonet mount slot 186 (see FIGS. 10–11). When the front of bayonet mount 418 abuts the front end of bayonet mount slot 186 (e.g., when the front end of rail 420 in rail slot 184 abuts stop 188), attachment fastener 146 may be inserted into bore 148 in forward region 142 of mount 104 so that attachment fastener 146 abuts rear face of bayonet mount 418 thereby interposing bayonet mount 418 between attachment fastener 146 and the front end of bayonet mount slot 186 (see FIGS. 9 and 12). In this configuration, the front end of bayonet slot 186, lateral shoulders 194, 196 and attachment fastener 146 help hold bayonet mount 418 in bayonet mount slot 186 to prevent movement of bayonet mount 418 inside bayonet mount slot 186 during use.

Figure 9:
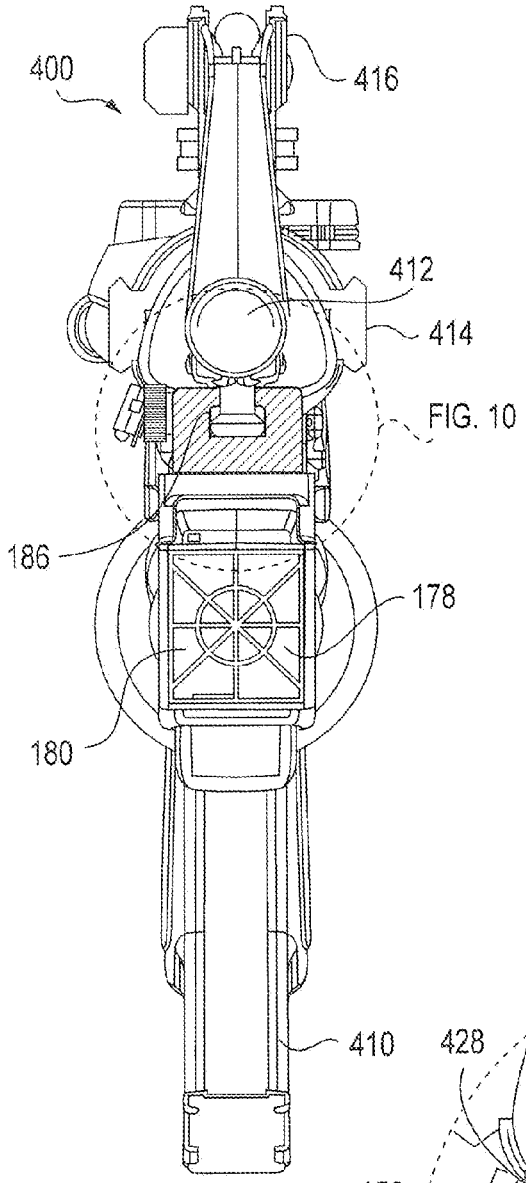
FIG. 9 is a front view of the weapon system of FIG. 4, a front portion of the weapon of FIG. 3 cut away to show in cross section the assembly of the weapon system of FIG. 4.
Figure 10:
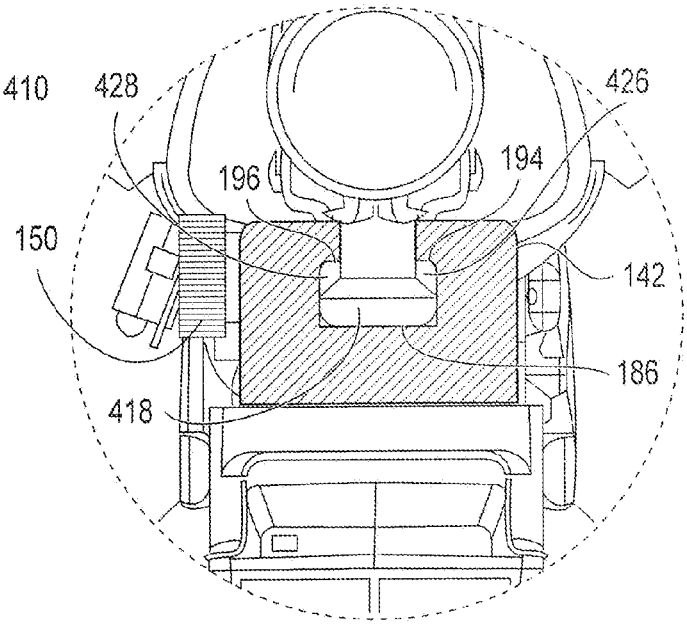
FIG. 10 is an enlarged portion F of the view of FIG. 9.
Figure 11:
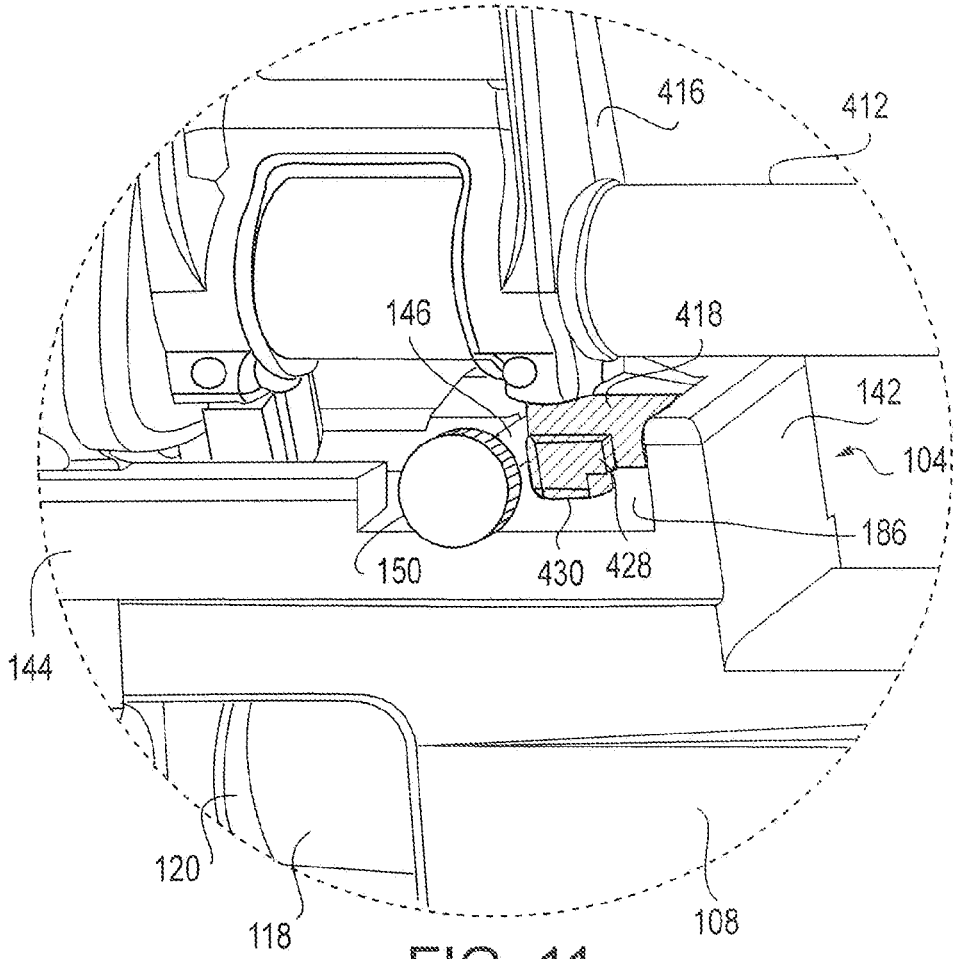
FIG. 11 is a perspective view of a portion of the weapon system of FIG. 4, a portion of track 144 generally below sight 416 cut away.

As shown in FIG. 9, an implementation of bayonet mount slot 186 may include a front step 210 along the bottom of bayonet mount slot 186. Front step 210 may serve as a front stop for abutting a lower protrusion 430 of bayonet mount 418 when fully inserted into bayonet mount slot 186.

With particular reference to FIGS. 5 and 7, a means for holding a cartridge (e.g., cartridge 112*b*) inserted into a compartment (e.g., compartment 132*a*) of cartridge store 106 is illustrated. Each compartment 132*a* may have an opposing pair of side notches 198, 200 for receiving corresponding locking tabs 202, 204 of the latches (e.g., latches 114*b*, 114*d*) of a cartridge 112*b*. When inserting a cartridge 112*b* into a compartment 132*a*, latches 114*b*, 114*d* may be deflected in such a manner that permits insertion of locking tabs 202, 204 into side notches 198, 200. To remove cartridge 112*b* from compartment 132*a*, latches 114*b*, 114*d* may be depressed to cause deflection of locking tabs 202, 204 in an inward direction and out of side notches 198, 200 thereby permitting cartridge 112*b* to be pulled out of compartment 132*a* in a downward direction through the open bottom of compartment 132*a*.

Each compartment may have resiliently compressible side walls 206, 208 (e.g., side walls made of a resiliently compressible material such as a foamed plastic or rubber) which are compressed by a cartridge 112*b* inserted into compartment 132*a*. Such resiliently compressible side walls 206, 208 further help to hold cartridge 112*b* securely in place in compartment 132*a* and may help reduce rattling by inhibiting movement of cartridge 112*b* when stored in compartment 132*a*.

After electric discharge weapon 100 has been mounted to firearm 400, electric discharge weapon 100 may be used as follows. A user holding firearm 400 inserts a finger into finger hole 118 so that the user can actuate primary actuator 120. If a secondary actuator 122 is included on electric discharge weapon 100, the user may also move secondary actuator 122 into the unlocked position so that primary actuator 120 may be actuated. Moving secondary actuator 122 to the unlocked position may also enable emission of light by light source 156. The user may then aim electric discharge weapon 100 at a target using sight 416 of firearm 400 with the assistance of light (e.g., laser and/or general illumination) provided by light source 156 toward the target. After the user has aimed electric discharge weapon 100 at the intended target, the user may then discharge the projectiles (e.g., probes) from cartridge 112*a* by actuating primary actuator 120 (e.g., pulling trigger 120). Projectiles are propelled toward the target and penetrate the clothing or skin of the target to complete a circuit and deliver charge into the target.

Electric discharge weapon 100 may be operated independently (e.g., without being attached to another weapon).

The foregoing description discusses preferred embodiments of the present invention which may be changed or modified without departing from the scope of the present invention as defined in the claims. While for the sake of clarity of description, several specific embodiments of the invention have been described, the scope of the invention is intended to be measured by the claims as set forth below.

What is claimed is:

1. A weapon for use with a particular cartridge and a plurality of cartridges against a target, the weapon comprising:

a. a receiver that receives the particular cartridge, the cartridge for applying a deterrent force to the target;

b. a trigger that activates the particular cartridge; and c. a cartridge store that stores the plurality of cartridges; wherein d. first the cartridge store, then the trigger, and then particular cartridge prior to activation are arranged in sequence proceeding linearly toward the target; and e. the weapon has an axis that passes through the particular cartridge, the trigger, and each cartridge stored in the cartridge store about which a user's hand at least partially wraps to hold and operate the weapon.

2. The weapon of claim 1 wherein the deterrent force comprises an electric charge delivered into the target.

3. The weapon of claim 1 wherein the cartridge store comprises a resiliently compressible wall for retaining a cartridge in the store.

4. The weapon of claim 1 wherein:

a. the cartridge store comprises a plurality of stations, each station for storing one of the cartridges; and b. the stations of the plurality are arranged proceeding linearly away from the user.

5. The weapon of claim 2 further comprising a battery located between the cartridge store and the trigger.

6. The weapon of claim 2 further comprising a high voltage power supply located between the trigger and the receiver.

7. The weapon of claim 2 further comprising a light source for illuminating the target, the light source located between the trigger and the receiver.

8. The weapon of claim 1 further for use with a second weapon having a rail, the rail having a second axis, the weapon further comprising a mount that fastens the weapon to the rail so that the second axis is substantially parallel to the axis of the weapon.

9. The weapon of claim 8 wherein the second weapon further has a bayonet receiver, and the mount further fastens the weapon to the bayonet receiver.

10. The weapon of claim 9 wherein the mount comprises a surface that interferes with at least a portion of the bayonet receiver to reduce sliding of the mount with respect to the rail.

11. The weapon of claim 10 wherein the mount comprises a threaded fastener that provides the surface.

12. An electric weapon for use with a host weapon, the host weapon having a bayonet receiver and a rail, the rail having a first axis, the electric weapon for use with a particular cartridge and further for use with a plurality of cartridges, each cartridge for applying a deterrent force to a target, the deterrent force comprising an electric charge delivered into the target, the electronic weapon having a second axis about which a user's hand at least partially wraps to hold and operate the electronic weapon, the electronic weapon comprising:

a. a receiver that receives the particular cartridge;

b. a trigger that activates the particular cartridge; and c. a cartridge store that stores the plurality of cartridges;

d. a mount that fastens the electronic weapon to the rail, and fastens the electronic weapon to the bayonet receiver; wherein e. first the cartridge store, then the trigger, and then the receiver are arranged in sequence proceeding linearly away from a user of the weapon; and f. the second axis passes through the particular cartridge, the trigger, and each cartridge stored in the cartridge store.

13. The weapon of claim 12 wherein the mount comprises a surface that interferes with at least a portion of the bayonet receiver to reduce sliding of the mount with respect to the rail.

14. The weapon of claim 13 wherein the mount comprises a threaded fastener that provides the surface.

* * * * *